US010935341B2

(12) United States Patent
Mann et al.

(10) Patent No.: US 10,935,341 B2
(45) Date of Patent: Mar. 2, 2021

(54) LIQUID JET EJECTION DEVICE

(71) Applicant: SPIN MASTER, INC., Williamsville, NY (US)

(72) Inventors: Joshua A. Mann, Virginia Beach, VA (US); Carl R. Romulus, Virginia Beach, VA (US); Timothy J. Clemens, Virginia Beach, VA (US); Franklin La Barbara, Rumford, RI (US)

(73) Assignee: SPIN MASTER, INC., Williamsville, NY (US)

( * ) Notice: Subject to any disclaimer, the term of this patent is extended or adjusted under 35 U.S.C. 154(b) by 0 days.

(21) Appl. No.: 16/100,595

(22) Filed: Aug. 10, 2018

(65) Prior Publication Data

US 2020/0049448 A1 Feb. 13, 2020

(51) Int. Cl.

| | |
|---|---|
| ***F41B 9/00*** | (2006.01) |
| *B05B 11/00* | (2006.01) |
| *B05B 15/30* | (2018.01) |

(52) U.S. Cl.

CPC ..... *F41B 9/004* (2013.01); *F41B 9/0059* (2013.01); *F41B 9/0081* (2013.01); *B05B 11/00412* (2018.08); *B05B 11/3009* (2013.01); *B05B 15/30* (2018.02); *F41B 9/0078* (2013.01)

(58) Field of Classification Search

CPC ... B05B 17/00; B05B 15/30; B05B 11/00412; B05B 11/3009; F41B 9/0081; F41B 9/0059; F41B 9/004; F41B 9/00; F41B 9/0009; F41B 9/0078; B63B 35/74

USPC ..... 446/220, 268; 222/78, 79

See application file for complete search history.

(56) References Cited

U.S. PATENT DOCUMENTS

| | | | | |
|---|---|---|---|---|
| 2,801,850 | A * | 8/1957 | Yount | B63B 35/74 446/220 |
| 2,909,959 | A | 10/1959 | Girden | |
| 5,605,485 | A | 2/1997 | Spector | |
| 5,609,507 | A | 3/1997 | Spector | |
| 5,886,839 | A | 3/1999 | Arnone et al. | |
| 7,331,839 | B2 | 2/2008 | Diffley | |
| 7,938,758 | B2 | 5/2011 | Publicover et al. | |
| 8,915,826 | B2 | 12/2014 | Publicover et al. | |
| 2012/0034585 | A1* | 2/2012 | Plante | A63B 69/187 434/253 |
| 2013/0153599 | A1* | 6/2013 | Todokoro | F41B 9/0037 222/79 |
| 2015/0190723 | A1* | 7/2015 | Liberatore | A63G 19/00 446/153 |
| 2017/0036846 | A1 | 12/2017 | Publicover et al. | |

* cited by examiner

*Primary Examiner* — Paul R Durand
*Assistant Examiner* — Robert K Nichols, II
(74) *Attorney, Agent, or Firm* — Millman IP Inc.

(57) ABSTRACT

A liquid jet ejection device is provided. The liquid jet ejection device has a flexible lumen having an intake end positioned to be in fluid communication with a liquid source, and an output end distal from the intake end. A pump is coupled to the flexible lumen, the pump being actuatable to eject a liquid from the liquid source via the output end. A body structure extends from a handle and supports the output end of the flexible lumen, the body structure having a base form in which the output end of the flexible lumen is supported in a base pose relative to the handle, the body structure being deformable from the base form via contact with an object, the body structure returning to the base form upon withdrawal of contact.

7 Claims, 5 Drawing Sheets

LIQUID JET EJECTION DEVICE

FIELD

The specification relates generally to children's toys. In particular, the following relates to a liquid jet ejection device.

SUMMARY OF THE DISCLOSURE

In one aspect, there is provided a liquid jet ejection device, comprising a flexible lumen having an intake end positioned to be in fluid communication with a liquid source, and an output end distal from the intake end, a pump coupled to the flexible lumen, the pump being actuatable to eject a liquid from the liquid source via the output end, a handle, and a body structure extending from the handle and supporting the output end of the flexible lumen, the body structure having a base form in which the output end of the flexible lumen is supported in a base pose relative to the handle, the body structure being deformable from the base form via contact with an object, the body structure returning to the base form upon withdrawal of contact with the object.

The liquid jet ejection device can further include a liquid reservoir that is the liquid source in which the intake end of the flexible lumen is positioned. The liquid reservoir can be a resealable compartment. The liquid jet ejection device can further comprise an actuator coupled to the pump to actuate the pump. The liquid jet ejection device can further include a rigid housing supporting the pump and the actuator. The rigid housing can include the liquid reservoir.

The body structure can be an inflatable body structure.

The body structure can be an inflatable body structure that is secured to the rigid housing. The body structure can be at least partially made from polyvinyl chloride.

The output end of the flexible lumen can be deflectable via deformation of the body structure.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
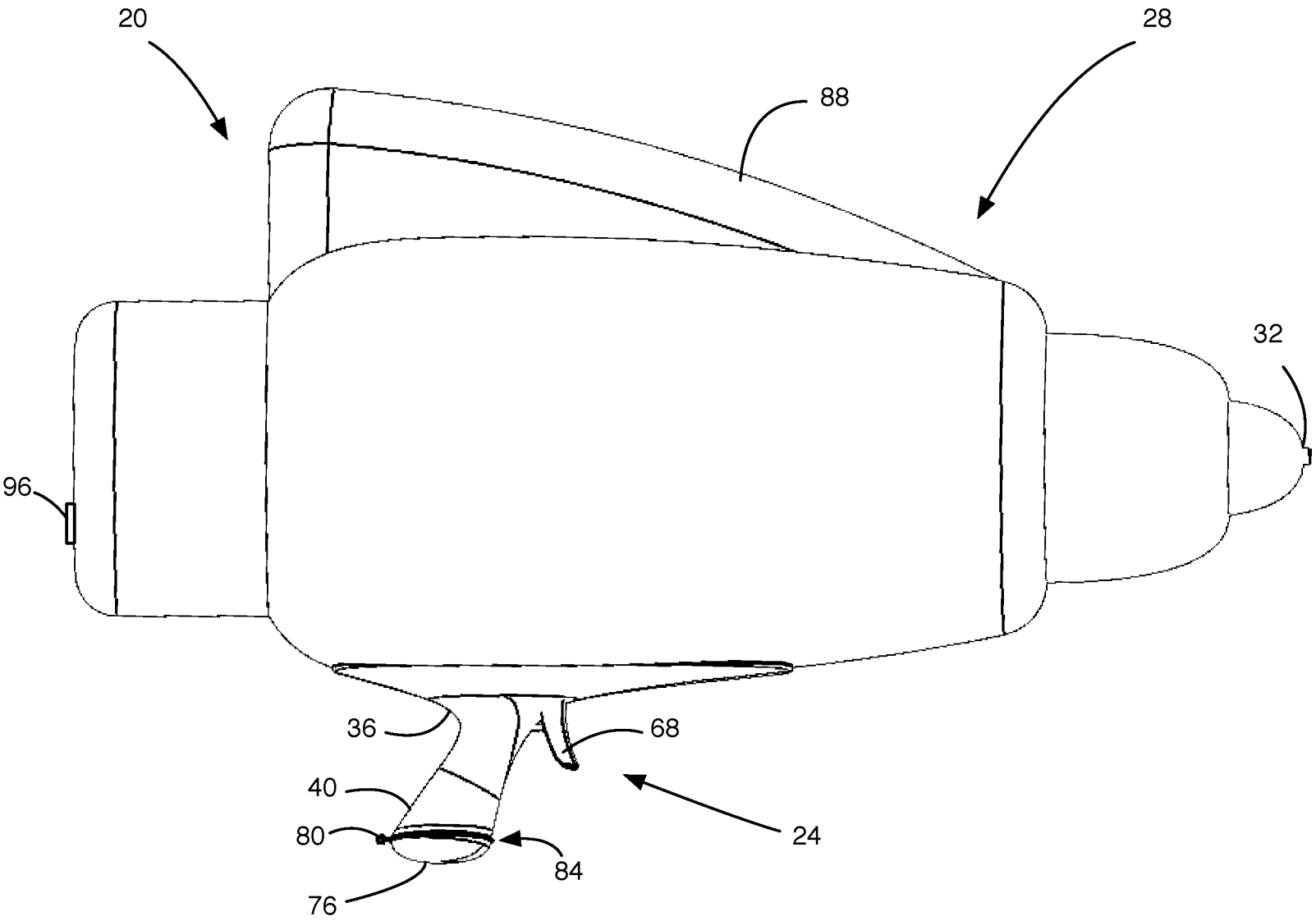
FIG. 1 is a left side elevation view a liquid jet ejection device in accordance with an embodiment.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

FIG. 1 shows a liquid jet ejection device 20 in accordance with an embodiment. In particular, the liquid jet ejection device 20 dispenses water in this embodiment, but it will be appreciated that other liquids can be dispensed by the liquid jet ejection device 20 in other embodiments. The liquid jet ejection device 20 has a generally inflexible handle portion 24 to which is secured an inflatable body structure 28 having the base form of an enlarged science fiction space gun as shown. The inflatable body structure 28 has a nozzle 32 that is generally held in a set pose relative to the handle portion 24 by the inflatable body structure 28 to enable aiming of a liquid dispensed therefrom.

Figure 2:
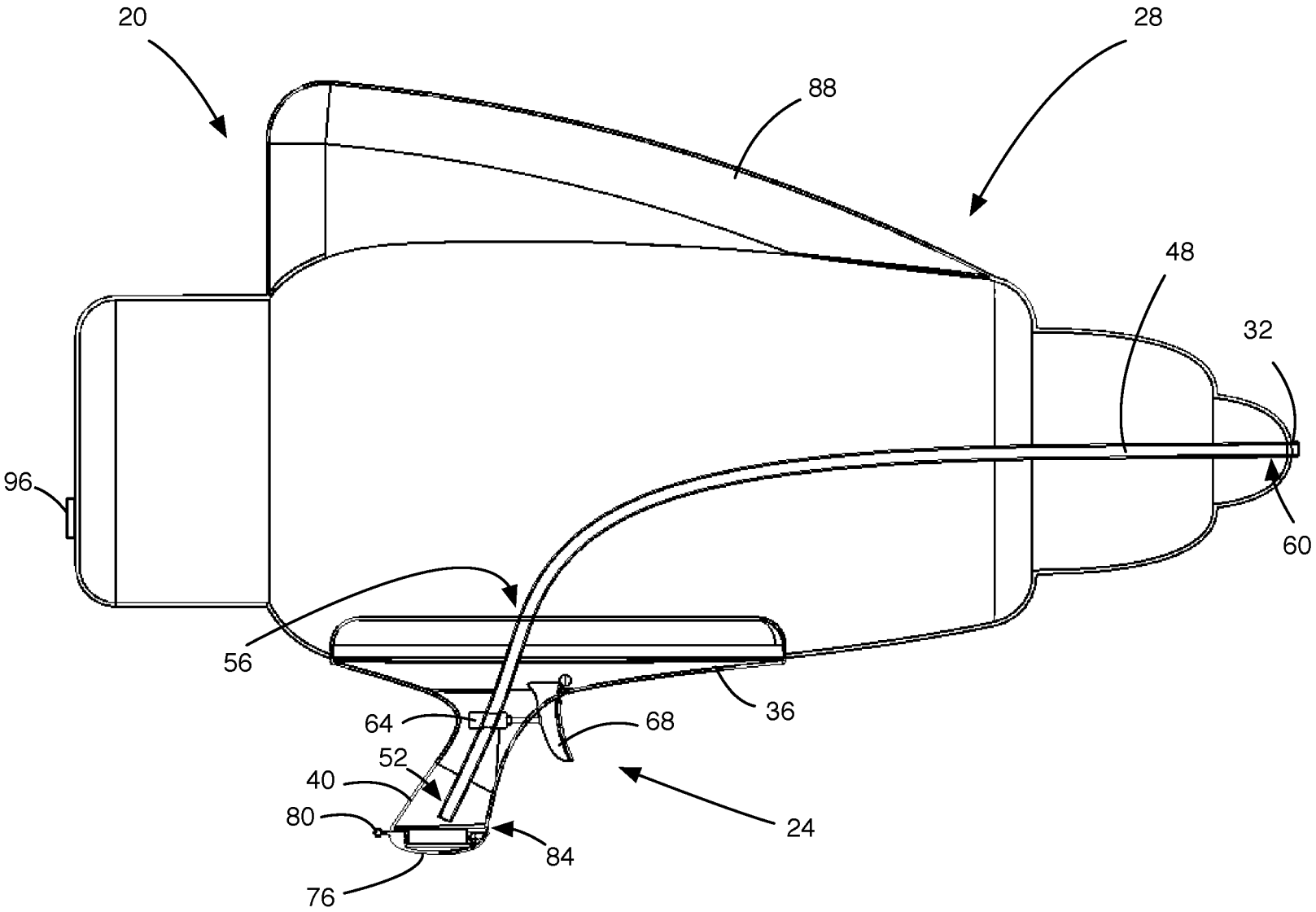
FIG. 2 is a left side section view of the liquid jet ejection device of FIG. 1.
Figure 3:
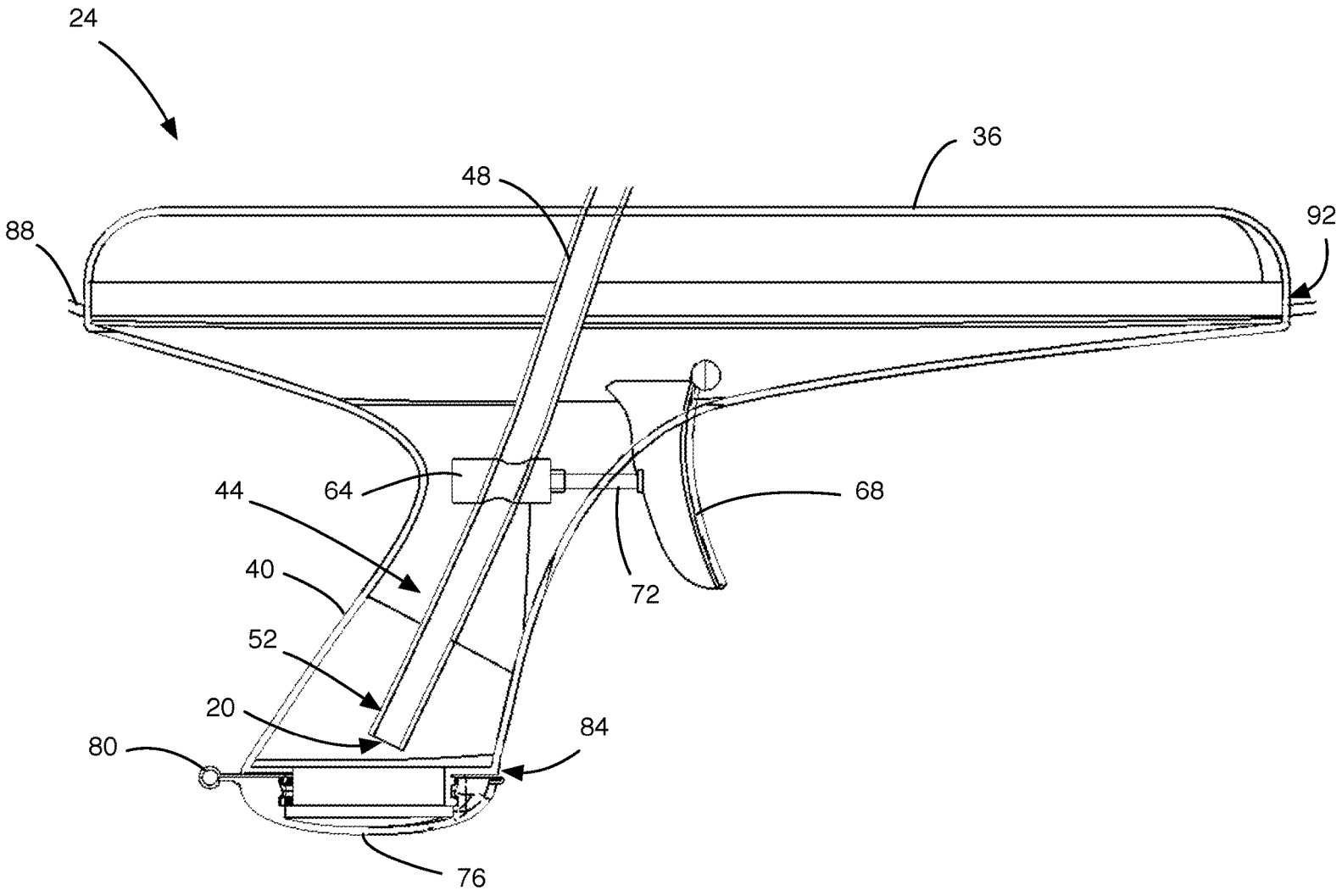
FIG. 3 is a left side partial section view of a handle portion of the liquid jet ejection device of FIG. 1.

Now with reference to FIGS. 1 to 3, the handle portion 24 of the liquid jet ejection device 20 includes a generally rigid housing 36 made primarily of a generally inflexible plastic. The housing 36 includes a handle 40 that is sized to be gripped by the hand of a child. The housing 36 of the handle portion 24 generally defines an enclosed reservoir 44 for water. The reservoir 44 is provided for holding a liquid (e.g. water) and is therefore an example of a liquid source that can be used to supply liquid to be ejected from the liquid jet ejection device 20.

A lumen 48 is positioned within the liquid jet ejection device 20 to channel water from the reservoir 44 and out through the nozzle 32. The lumen 48 is sufficiently flexible to enable deflection of the lumen 48 with deformation of the inflatable body structure 28. In particular, an intake end 52 of the lumen 48 is disposed in the reservoir 44 within the handle portion 24 to draw water. The lumen 48 extends from the first end 52 (referred to also as an intake end 52), through a lumen aperture 56 in the top surface of the handle portion 24, and through the inflatable body structure 28. A second end 60 of the lumen 48 (referred to also as an output end 60) distal the first end 52 is secured to a nozzle insert that is welded to the inflatable body structure 28. In alternative embodiments, the second end 60 may be secured directly to the inflatable body structure 28.

A pump is provided and is actuatable to eject liquid from the liquid source (e.g. the reservoir 44) via the output end 60 of the lumen 48. The pump may be any suitable type of pump. As is known in the art of water pistols, the pump may be in the form of a spring valve 64 with a holding chamber that is positioned along the lumen 48. The holding chamber has a piston therein. The piston is connected to a trigger post 72 that extends out from the holding chamber and which is connected to a trigger 68. The trigger post 72 is spring biased towards an extended position (i.e. outwards from the holding chamber) via a biasing spring (not shown). First and second check valves control the flow of water into and out from the holding chamber. Actuation of the trigger 68 causes the trigger post 72 to act against the biasing spring and to drive the piston to expel water from the holding chamber through the lumen 48 towards the nozzle 32, thereby ejecting water from the liquid jet ejection device 20. Release of the trigger 68 enables the biasing spring in the spring valve 64 to move the trigger post 72 outward from the holding chamber, thus drawing in water from the reservoir 44 into the holding chamber via the first end 52 of the lumen 48. The trigger post 72 is sealed with the housing 36 to prevent leakage of water within the reservoir 44.

A refilling cap 76 is snap fit to a bottom end of the housing 36 and is pivotally coupled to the housing 36 via a hinge 80. In this case, the hinge 80 is a living hinge. A seal gasket 84 along the edge of the refilling cap 76 prevents leakage between the housing 36 and the refilling cap 76. Other types of openings for refilling the reservoir 44 can be provided in other embodiments.

The inflatable body structure 28 is primarily made from an 8 gauge polyvinyl chloride ("PVC") shell 88 or other suitably flexible material that is welded or otherwise sealingly secured to the housing 36 of the handle portion 24 along a weld line 92. The PVC shell 88 is welded to the nozzle insert forming the nozzle 32 and thus provides an air-tight enclosure. Inflation and/or deflation of the PVC shell 88 is achieved by an air valve 96. Once inflated, the inflatable body structure 28 is primarily an air structure encapsulated by the PVC shell 88, which provides a flexible and compliant casing through which the lumen 48 extends. The design of the PVC shell 88 determines the overall appearance of the liquid jet ejection device 20.

The nozzle 32 is preferably designed to sit generally flush with the PVC shell 88 or be recessed within the base form provided by the inflatable body structure 28 when inflated and not impinged upon by other object. In this way, there is less risk of the nozzle 32 injuring a human via contact with the front end of the liquid jet ejection device 20.

The inflatable body structure 28 is sufficiently rigid when inflated so that the set pose of the nozzle 32 relative to the handle portion 24 and thus the handle 40 is maintained. When the inflatable body structure 28 is pushed into contact with a physical object, such as a human, it can be deformed. As the lumen 48 is flexible, it can deform with the inflatable body structure 28 so that the nozzle 32 can be deflected from the base pose to reduce the risk of causing harm to a human. Upon withdrawal of contact with the physical object, the inflatable body structure 28 returns to the base form and the nozzle 32 secured thereto returns to the base pose. Thus, the liquid jet ejection device 20 can deform when the front end thereof contacts a person to reduce the risk of injury and thereafter return to its prior state. In its prior state, the second end 60 of the lumen 48 and the nozzle 32 assume the base pose, enabling the liquid jet ejection device 20 to be predictably aimed.

Figure 4:
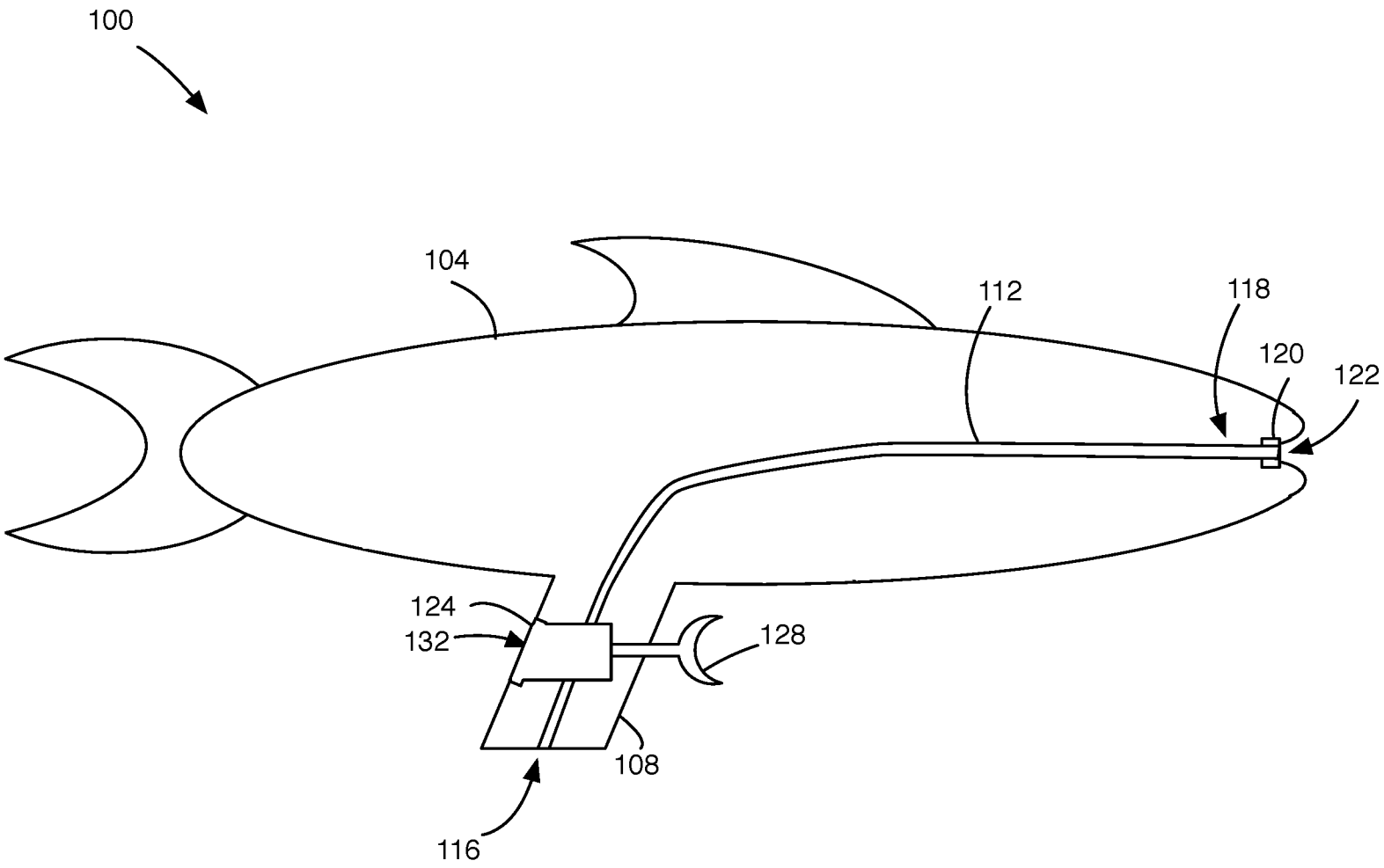
FIG. 4 is a left side schematic view of a liquid jet ejection device in accordance with another embodiment.

FIG. 4 shows a liquid jet ejection device 100 in accordance with another embodiment. In this embodiment, the liquid jet ejection device 100 has an inflatable body structure 104 similar to that of the liquid jet ejection device 20 of FIGS. 1 to 3. The inflatable body structure 104 includes a handle 108. The inflatable body structure 104 can be made of a PVC shell or other suitably flexible material. The handle 108 may be reinforced to provide less flexibility in the handle 108, thereby providing greater predictability of the aim of the liquid jet ejection device 100. A lumen 112 is disposed within the inflatable body structure 104 and extends from an intake end 116 that is exposed at the bottom of the handle 108 to an output end 118 secured to a nozzle insert 120 forming a nozzle 122 that is positioned at a front end of the liquid jet ejection device 100. A pump 124 is positioned within the handle 108 and is actuated via an actuator in the form of a trigger 128. A palm rest 132 on a rear surface of the pump 124 enables movement, or "squeezing", of the trigger 128 relative to the pump 124. The palm rest 132 may extend outside of the inflatable body structure 104 and sealed therewith. Alternatively, the palm rest 132 can be positioned within the inflatable body structure. In this case, it is preferable that the pump 124 is secured to an inside surface of the inflatable body structure 104.

As can be seen, the nozzle insert 120 is recessed relative to the front end of the liquid jet ejection device 100 so that the risk of accidental contact with the nozzle is reduced.

The liquid jet ejection device 100 can be positioned so that the intake end 116 is in fluid communication with a liquid source, such as the water of a swimming pool or a natural body of water. Actuation of the trigger 128 causes the pump 124 to draw water into the intake end 116 and expel it via the output end 118 and the nozzle insert 120.

The inflatable body structure 104 is sufficiently rigid when inflated so that the set pose of the nozzle insert 120 relative to the handle 108 is maintained. When the inflatable body structure 104 is pushed into contact with a physical object, such as a human, it can be deformed. As the lumen 112 is flexible, it can deform with the inflatable body structure 104 so that the nozzle insert 120 can be deflected from the base pose to reduce the risk of causing harm to a human. Upon withdrawal of contact with the physical object, the inflatable body structure 104 returns to the base form and the nozzle insert 120 secured thereto returns to the base pose. Thus, the liquid jet ejection device 100 can deform when the front end thereof contacts a person to reduce the risk of injury and thereafter return to its prior state. In its prior state, the output end 118 of the lumen 112 and the nozzle insert 120 assume the base pose, enabling the liquid jet ejection device 100 to be predictably aimed.

Figure 5:
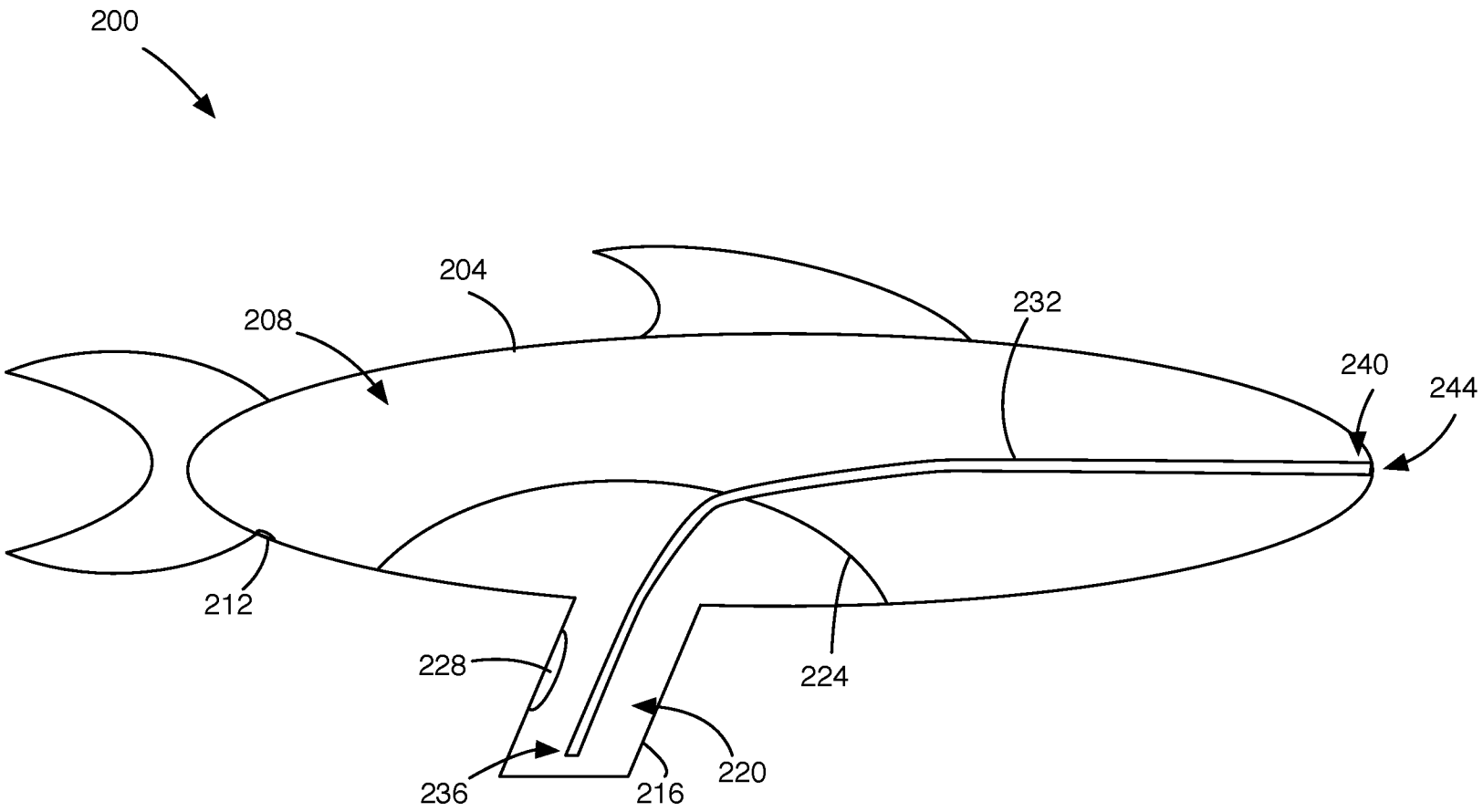
FIG. 5 is a left side schematic view of a liquid jet ejection device in accordance with yet another embodiment.

FIG. 5 shows a liquid jet ejection device 200 in accordance with yet another embodiment. In this embodiment, the liquid jet ejection device 200 has an inflatable body structure 204 similar to that of the liquid jet ejection device 20 of FIGS. 1 to 3. The inflatable body structure 204 houses an air bladder 208 that is refillable via a resealable valve 212. A handle 216 is secured to the inflatable body structure 204. The inflatable body structure 204 and the handle 216 can be made of a PVC shell or other suitably flexible material. The handle 216 may be reinforced to provide less flexibility in the handle 216, thereby providing greater predictability of the aim of the liquid jet ejection device 200. A liquid reservoir 220 occupies at least the handle 216 of the liquid jet ejection device 200 and is separated from the air bladder 208 by a membrane 224. The liquid reservoir 220 acts as a liquid source for the liquid jet ejection device 200. A resealable cap 228 enables refilling of the liquid reservoir 220.

A flexible lumen 232 is disposed within the inflatable body structure 204 and the handle 216 and extends from an intake end 236 that is positioned in the bottom of the liquid reservoir 220 to an output end 240 secured to the inflatable body structure 204. The output end 240 acts as a nozzle 244 that is positioned at a front end of the liquid jet ejection device 200. The handle 216 acts as a pump, as constriction of the handle 216 causes liquid from the liquid reservoir 220 to enter the intake end 236 of the flexible lumen 232 and exit the output end 240.

The handle 216 can be made sufficiently rigid so that, after deformation of the handle 216, the handle 216 reverts to its original form, thereby drawing in air to replace the displaced liquid. In one alternative embodiment, a spring valve can be deployed in the membrane 224 to allow air in the air bladder 208 to flow into the liquid reservoir 220.

The inflatable body structure 204 is sufficiently rigid when inflated so that the set pose of the nozzle 244 relative to the handle 216 is maintained. When the inflatable body structure 204 is pushed into contact with a physical object, such as a human, it can be deformed. As the lumen 232 is flexible, it can deform with the inflatable body structure 204 so that the nozzle 244 can be deflected from the base pose to reduce the risk of causing harm to a human. Upon withdrawal of contact with the physical object, the inflatable body structure 204 returns to the base form and the nozzle 232 secured thereto returns to the base pose. Thus, the liquid jet ejection device 200 can deform when the front end thereof contacts a person to reduce the risk of injury and thereafter return to its prior state. In its prior state, the output end 240 of the lumen 232 and the nozzle 244 assume the base pose, enabling the liquid jet ejection device 200 to be predictably aimed.

In other embodiments, the flexible lumen can be confined within the inflatable body structure.

Other types of pumps and actuators to cause the liquid to travel towards the output end of the lumen can be employed.

While, in the above-described embodiments, the body structure is constructed to be inflatable, it can be made in other manners to support the flexible lumen in a stable manner to enable predictable aiming of a liquid stream ejected from the ejection device, while enabling deformation upon contact with an object. For example, the body structure can be constructed from a foam or a plush filled fabric cover.

Persons skilled in the art will appreciate that there are yet more alternative implementations and modifications possible, and that the above examples are only illustrations of one or more implementations. The scope, therefore, is only to be limited by the claims appended hereto and any amendments made thereto.

LIST OF REFERENCE NUMERALS

20 liquid jet ejection device
24 handle portion
28 inflatable body structure
32 nozzle
36 housing
40 handle
44 reservoir
48 lumen
52 first end, intake end
56 lumen aperture
60 second end, output end
64 spring valve
68 trigger
72 trigger post
76 refilling cap
80 hinge
84 seal gasket
88 polyvinyl chloride shell
92 weld line
96 air valve
100 liquid jet ejection device
104 inflatable body structure
108 handle
112 lumen
116 intake end
118 output end
120 nozzle insert
122 nozzle
124 pump
128 trigger
132 palm rest
200 liquid jet ejection device
204 inflatable body structure
208 air bladder
212 resealable valve
216 handle
220 liquid reservoir
224 membrane
228 resealable cap
232 flexible lumen
236 intake end
240 output end
244 nozzle

The invention claimed is:

1. A liquid jet ejection device, comprising:

a flexible lumen having an intake end positioned to be in fluid communication with a liquid source, and an output end distal from the intake end;

a pump coupled to the flexible lumen, the pump being actuatable to eject a liquid from the liquid source via the output end;

a handle including a rigid housing enclosing a resealable liquid reservoir that is the liquid source with which the intake end of the flexible lumen is in fluid communication; and a body structure extending from the handle and supporting the output end of the flexible lumen, the body structure having a base form in which the output end of the flexible lumen is supported in a base pose relative to the handle, the body structure being deformable from the base form via contact with an object, the output end of the flexible lumen being deflectable from the base pose relative to the handle via deformation of the body structure, the body structure returning to the base form upon withdrawal of contact with the object, wherein the handle solely supports the body structure when the handle is held by a person.

2. A liquid jet ejection device as claimed in claim 1, further comprising an actuator coupled to the pump to actuate the pump.

3. A liquid jet ejection device as claimed in claim 2, wherein the rigid housing houses the pump and the actuator.

4. A liquid jet ejection device as claimed in claim 3, wherein the body structure is an inflatable body structure that is secured to the rigid housing.

5. A liquid jet ejection device as claimed in claim 4, wherein the body structure is at least partially made from polyvinyl chloride.

6. A liquid jet ejection device as claimed in claim 1, wherein the body structure is an inflatable body structure.

7. A liquid jet ejection device as claimed in claim 1, wherein the output end of the flexible lumen is deflectable via deformation of the body structure.

* * * * *